US005863507A

United States Patent [19]

James

[11] Patent Number: 5,863,507

[45] Date of Patent: Jan. 26, 1999

[54] BENCHTOP COOLER

[76] Inventor: Lizymol James, 4 Gentry La., Uxbridge, Mass. 01569

[21] Appl. No.: 744,604

[22] Filed: Nov. 7, 1996

[51] Int. Cl.[6] ..... B01L 9/00

[52] U.S. Cl. ..... 422/104; 422/101; 422/102; 422/100; 436/180; 435/305.1; 435/305.3

[58] Field of Search ..... 422/100, 102, 422/101, 103, 104; 436/180; 435/305.3, 305.4, 305.1, 305.2

[56] References Cited

U.S. PATENT DOCUMENTS 4,950,608 8/1990 Kishimoto ..... 435/290
5,525,300 6/1996 Danssaert et al. ..... 422/99
5,587,321 12/1996 Smith et al. ..... 435/305.3

*Primary Examiner*—Harold Y. Pyon
*Attorney, Agent, or Firm*—Brian M. Dingman

[57] ABSTRACT

An apparatus for holding laboratory tubes while in use, or while the tubes are being stored. The apparatus comprises a thermally conductive tube holding element disposed within an insulating member and a cooling element. The apparatus is capable of holding a large number of laboratory tubes and keeping them at a cool temperature for extended periods of time on a laboratory workbench. The apparatus is also useful for storing a large number of temperature-sensitive samples in laboratory tubes in a freezer, to protect the samples in case of freezer failure.

16 Claims, 2 Drawing Sheets

BENCHTOP COOLER

FIELD OF THE INVENTION

This invention relates generally to an apparatus for holding laboratory tubes, and more particularly concerns an apparatus that will maintain the laboratory tubes at a cool temperature for extended periods of time while in use, and is also useful for holding temperature-sensitive samples in the laboratory tubes while in storage.

BACKGROUND OF THE INVENTION

Scientific Laboratories use a large number of expensive samples which are kept in small laboratory tubes when in use. Samples herein is used to encompass analytical reagents, restriction enzymes, RNA, proteins, samples and other similar laboratory materials. If the samples are allowed to warm they will begin to deteriorate and become less effective possibly producing inaccurate results. Therefore, it is important to keep the samples at a constant cool temperature to preserve their effectiveness and extend their working life.

Scientists have taken various approaches to maintain the cool temperature of the samples while working with them. One such approach has been working with the samples in a temperature controlled room. This method, while effective, is very inconvenient for the scientist as extended periods of time must be spent in a cold environment. Another problem associated with this method is the cost of maintaining a room at a constant cold temperature.

Another method scientists have used is to keep the samples in a refrigerator or freezer while in use. To employ this method, the scientist would be required to leave the door to the refrigerator or freezer open, or constantly open and close it. This method is inconvenient for scientists for several reasons. First, if the tubes containing the samples are opened in the refrigerator or freezer, there is a high risk of contamination from other materials present. Second, the scientist is generally holding several pieces of laboratory equipment, such as pipettes, and therefore it is not convenient to constantly open and close the refrigerator or freezer door.

Another procedure scientists use to maintain the samples at a constant temperature is an ice-bath. The laboratory tubes containing the samples are placed in a beaker, bucket or other suitable container, in which ice has been added. This procedure suffers from several inconveniences. First, as the ice melts, new ice must be added to continue to cool the samples and water must be removed to provide room for the new ice to be added. Another problem is, as the ice melts and water builds up in the ice bath, the laboratory tubes may begin to float, become unsteady and could tip over, thereby losing or contaminating the sample. A further problem with this procedure is that it is impractical for use with a large number of laboratory tubes and is a very unorganized procedure.

There have been attempts in the prior art to address these problems, but these attempts suffer from additional drawbacks. One such apparatus is a Thermosafe Benchtop System laboratory tube holder with a base for placing a cold pack. This apparatus suffers from several disadvantages. First, the apparatus is large and takes up a substantial amount of laboratory bench and freezer space thereby not being efficient. Second, the only portion of the laboratory tube which may touch a cooling element is the bottom, the remainder of the laboratory tube is surrounded by air or the foam holder resulting in uneven cooling of the samples, and a shorter period of time the apparatus will keep the tubes cool. Furthermore, there is no assurance that the tubes will be in contact with the cooling element resulting in a slower cooling time. Third, the capacity of the apparatus for holding tubes is very low and not designed for compatibility with other standard laboratory equipment, inconveniencing a scientist using such an apparatus. Fourth, the holes for the laboratory tubes do not hold the tubes firmly and thus the tubes may fall out if the device is tipped at an angle. Fifth, the tube holder portion of the apparatus does not fit securely onto the base resulting in an unstable apparatus. Finally, the materials of construction and design do not provide a rigid and secure apparatus, qualities which, given the high cost of reagents and irreplaceable nature of many samples, are essential in a laboratory tube holder.

Accordingly there is a great need for a device that will quickly cool laboratory tubes and maintain them at a constant temperature wherein the device is durable, has a high capacity and small design, is convenient and easy to use, is not costly to manufacture and is compatible with other standard laboratory equipment.

SUMMARY OF THE INVENTION

It is therefore an object of the present invention to provide a laboratory tube holder that rapidly cools the tubes and samples it is holding, minimizing any degradation of the samples.

It is a further object of the present invention to provide a laboratory tube holder that will maintain the laboratory tubes at a constant temperature.

It is a further object of the present invention to provide a laboratory tube holder that is convenient and efficient to use.

It is a further object of the present invention to provide a laboratory tube holder which will hold a large number of tubes.

It is a further object of the present invention to provide a laboratory tube holder that takes up as small amount of room as possible while holding a sufficient number of tubes.

It is a further object of this invention to provide a laboratory tube holder in which the majority of the laboratory tube surfaces are exposed to a cooling element or thermally conductive material.

It is a further object of this invention to provide a laboratory tube holder which will securely hold the laboratory tubes, and provide a stable working platform.

It is a further object of this invention to provide a laboratory tube holder whose design and materials of construction characterize it as a strong, secure and stable device.

It is a further object of this invention to provide a laboratory tube holder which is compatible with other standard laboratory equipment.

This invention results from the realization that a laboratory tube holding element may be constructed out of a thermal conducting material, thereby ensuring that the laboratory tubes are maintained at a constant cool temperature. The laboratory tubes are placed in blind holes in the tube holding element. The shape of the holes is similar to that of the tubes, and very close to their diameter, allowing the tubes to rest on the bottom, as well as ensuring that the bottom and a portion of the sidewalls of the tube will always be in contact with a thermally conductive material. The tube holding element is placed on top of, or next to a cooling element, and the combination is then surrounded by an insulating member to secure the parts together, and lengthen the period of time the insulated laboratory tube holder will keep the laboratory tubes cool. An insulating cover may then be placed over the tube holding element to reduce the possibility of contamination and the further lengthen the period of time which the tubes will remain cool.

The above and other objects are achieved in accordance with the present invention which, according to a first aspect, provides an insulated laboratory tube holder. The apparatus comprises a tube holding element made of a thermally conductive material, a cooling element, an insulating member and an insulating cover. The tube holding element has a plurality of defined openings on its top surface for placement of the laboratory tubes. The openings extend partially through the tube holding element and have a conical shaped bottom. The locations of the defined openings are staggered to allow for a maximum number of tubes to be held while the apparatus uses a minimum amount of space. The cooling element is placed into a defined cavity in the insulating member. The tube holding element is then place on top of the cooling element in the insulating member. The insulating member is designed such that it surrounds the tube holding element on all sides except the top. A tight fitting insulating cover is then place on the top of the insulating member.

A second aspect of the invention is comprised of a tube holding element made of a thermally conductive material, an insulating member, several cylinder shaped cooling elements and an insulating cover. The tube holding element has a plurality of defined openings on its top surface for placement of the laboratory tubes. The openings extend partially through the tube holding element and have a conical shaped bottom. The locations of the defined openings are aligned such that they will match up to a standard multi-tipped pipette used in scientific labs. This will allow the apparatus of this invention to be used in conjunction with standard multi-tipped pipettes and thereby be more efficient and convenient for the scientist. The insulating member also has a plurality of holes completely through the insulating member in the sides for the insertion of the cooling elements. The cooling elements are inserted into the holes defined for them. The tube holding element is then placed into the insulating member which surrounds the tube holding element on all sides except the top. The cooling elements are positioned substantially transverse to the openings for the tubes. A tight fitting insulating cover is then placed on the top of the insulating member.

A third aspect of the invention is comprised of a tube holding element made of a thermally conductive material, an insulating member, a cooling element and an insulating cover. The tube holding element has a plurality of defined openings on its top surface for placement of the laboratory tubes. The openings extend partially through the tube holding element and have conical shaped bottoms. The defined openings are arranged in an array of 8 columns by 12 rows for compatibility with standard 96-well plates used in scientific labs. This will allow samples from standard 96-well plates to be placed in the same position in the apparatus of this invention as they were in the 96-well plate for easier identification of the samples and thereby be more efficient and convenient for the scientist. At the end of each column and row is a means for labeling the column and row to facilitate even further identification of the samples. The tube holding element also has a rectangular opening extending through the tube holding element substantially transverse to the openings for the laboratory tubes for insertion of the cooling element. The cooling element is then placed in the hole defined for it. The tube holding element and cooling element combination is then placed into the insulating which surrounds the tube holding element on all sides except the top. A tight fitting insulating cover is then placed on top of the insulating member.

According to a fourth aspect of the apparatus of the present invention, the single cooling element may be replaced with up to twelve individual cooling elements. Preferably, the individual cooling elements are positioned in cavities directly beneath the rows of openings for laboratory tubes in the tube holding element. Alternatively, the cooling element may be a single electric cooling element for extended periods of use.

A fifth aspect of the invention combines the insulating member and the tube holding element into one component of the apparatus. According to this aspect, a material which maintains both thermally conductive and insulating properties must be used for the manufacture of the combined tube holding element and insulating member. One material which may be suitable is an epoxy, partially impregnated with aluminum filings. Any of the previously detailed cooling elements may be used with this aspect of the invention.

BRIEF DESCRIPTION OF THE DRAWINGS

Other objects, features and advantages of this invention will occur to those skilled in the art from the following description of a preferred embodiment and the accompanying drawings, in which.

DETAILED DESCRIPTION OF THE PREFERRED EMBODIMENT

Figure 1:
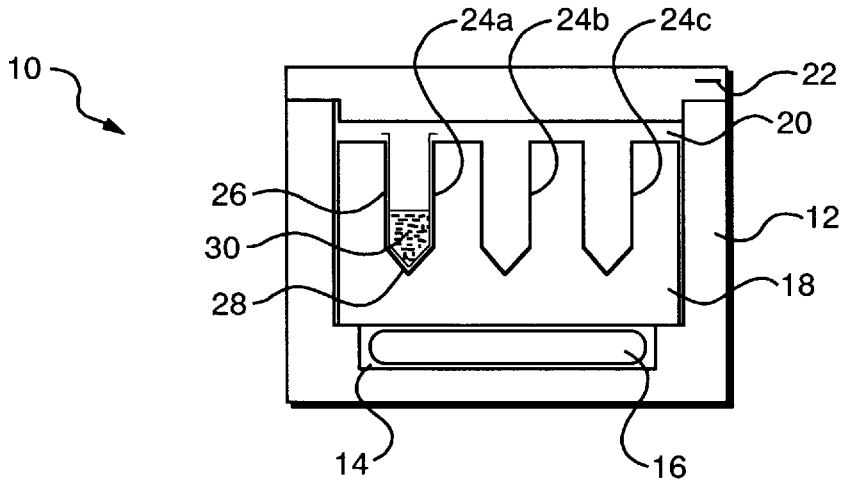
FIG. 1 is a side view, in cross section, of a preferred embodiment of the apparatus of this invention.
Figure 2:
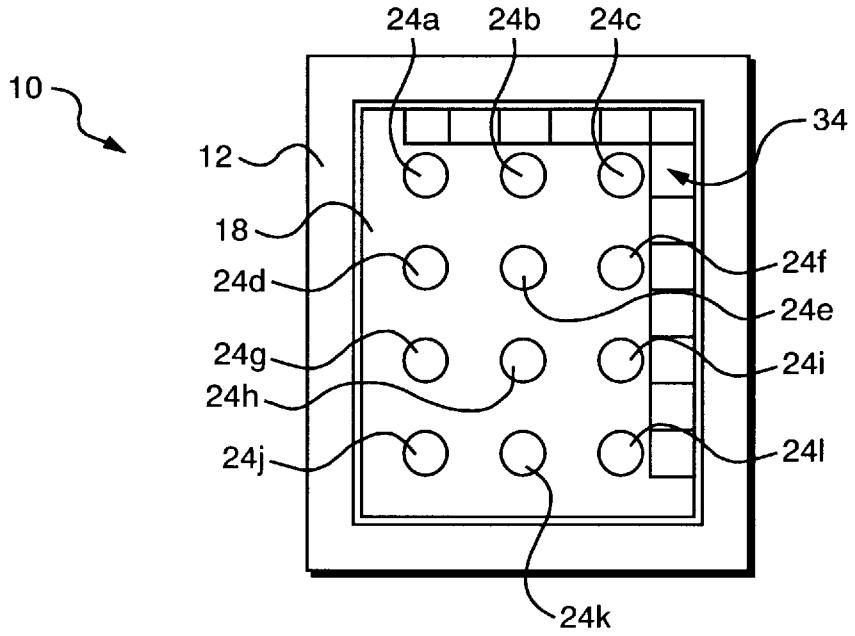
FIG. 2 is a top view of the apparatus of this invention shown in FIG. 1.

FIGS. 1 and 2 show in cross section and a top view, a preferred embodiment, of the insulated laboratory tube holder of this invention. The insulated laboratory tube holder 10 comprises an insulating member 12, for example a Styrofoam box, which has a defined cavity 14 for a cooling element 16. Cooling element 16 may be a standard get-type enclosed freezer pack. Located directly above the cooling element 16 is the tube holding element 18. The tube holding element 18 fits securely into a defined opening 20 in the insulating member 12. An insulating cover 22 is then place on top of the insulating member 12.

The tube holding element 18 has a plurality of defined openings 24*a–l* for placement of the laboratory tube 26. The openings have a diameter just slightly larger than that of the tubes, to increase the area of contact of the tubes and the tube holding element, which speeds cooling of the samples held in the tubes. The defined openings 24*a–l* extend partially through the tube holding element 18 and have a conical shaped bottom 28. The purpose of the conical shaped bottom 28 is to provide an increased area of contact between the tube holding element 18 and the conical-bottom laboratory tube 26. Because the tube holding element 18 is constructed out of a thermally conductive material, preferably aluminum, it quickly draws heat away from the laboratory tube 26, thereby rapidly cooling the sample 30 in the laboratory tube 26. The depth of the defined openings 24*a–l* is designed such that the top 32 of the laboratory tube 26 rests slightly above the top face of the tube holding element 18, thus allowing for the laboratory tube 26 to be easily removed from the tube holding element 18. Positioned on the tube holding element 18, at the end of each row and column of defined openings 24*a–l*, is a means 34 for labeling 34 each of the rows and columns of defined openings 24*a–l*, for example by using stenciled letters and/or number. Although this embodiment displays an array of 3 columns by 4 rows, there may be any number of rows and columns. Specifically included in the claims is an array of 8 columns by 12 rows such that the location of the holes will match up with those on a standard laboratory 96-well plate. Also, the hole diameters are established based on the diameter of standard tubes, including those of 0.2, 0.5, 1.5 and 2 ml volume.

Figure 3:
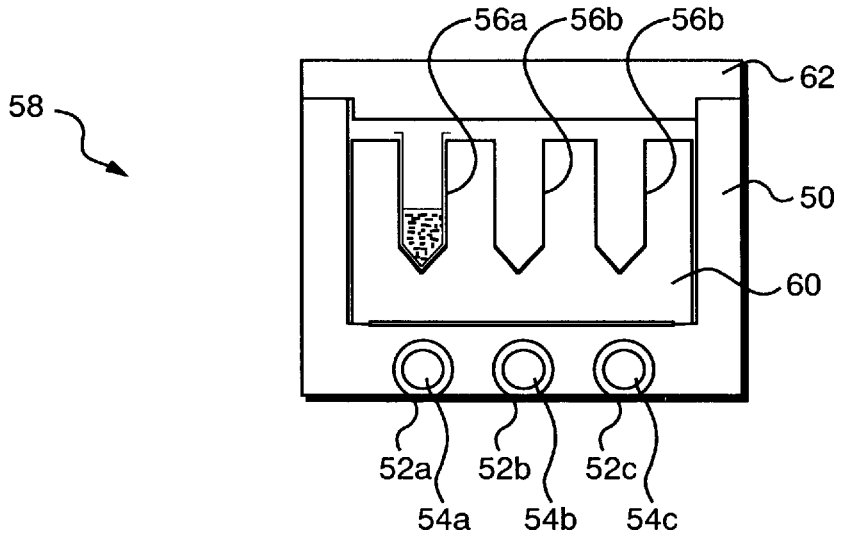
FIG. 3 is a side view, in cross section, of an alternative insulating member for use with the apparatus of this invention.

FIG. 3 shows a side view of an alternative insulating member 50 for use with the insulated laboratory tube holder 58 of this invention. In this embodiment, the insulating member 50 has holes 52*a–c* extending completely therethrough. Tubular cooling elements 54*a–c* are placed within the aforementioned holes 52*a–c*. The holes 52*a–c* are located directly under the openings 56*a–c* in the tube holding element 60, and extend substantially transverse thereto. An insulating cover 62 is then placed on top of the insulating member 50. The purpose of positioning the cooling elements 54*a–c* in the insulating member 50 is to allow for the cooling elements 54*a–c* to be replaced with new cooling elements without removing the tube holding element 60 from the insulating member 50. This results in an unlimited working time using the insulated laboratory tube holder 58 of this invention so long as the cooling elements 54*a–c* are regularly replaced with new ones.

Figure 4:
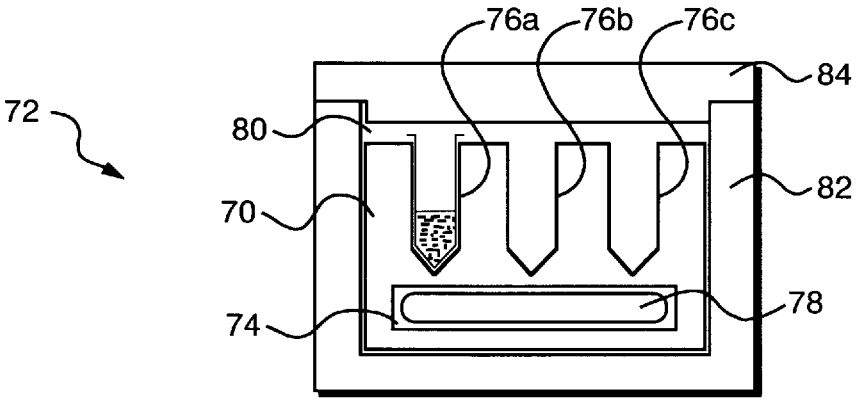
FIG. 4 is a side view, in cross section of an alternative tube holding element for use with the apparatus of this invention.

FIG. 4 shows a side view of an alternative tube holding element 70 for use with the insulated laboratory tube holder 72 of this invention. In this embodiment, the tube holding element 70 has a defined rectangular opening 74 extending completely therethrough substantially transverse to the openings 76*a–c* for the laboratory tubes. The cooling element 78 is placed in the rectangular opening 74 in the tube holding element 70. The purpose of placing the cooling element 78 in the tube holding element 70 is to facilitate rapid cooling of the tube holding element 70 and consequently the laboratory tubes and samples. The tube holding element 70 and cooling element 78 are then placed into a defined opening 80 in the insulating member 82, and an insulating cover 84 is then placed on top of the insulating member.

The insulating box of this invention may be coated with acrylic particles. Such adds a texture which provides a better grip to lessen the chance of dropping the box. Also, the coating adds strength and durability, and can be configured to add additional thermal insulation.

Although specific features of this invention are shown in some drawings and not others, this is for convenience only as each feature may be combined with any or all of the other features in accordance with the invention.

Other embodiments will occur to those skilled in the art and are within the following claims:

I claim:

1. A laboratory tube holder for cooling samples held in laboratory tubes, comprising:

an insulating member defining an interior opening having an upper opening chamber and a lower opening chamber;

a self-contained, removable cooling element disposed entirely within said lower opening chamber of said opening; and a thermally conductive tube holding element having a bottom surface, and disposed within said upper opening chamber of said opening, said lower surface proximate to said cooling element, said tube holding element having a top surface, and including a plurality of blind openings communicating with said top surface for holding the laboratory tubes therein;

whereby the contents of the tubes are cooled by conduction of heat through the tube holding element, and into said cooling element.

2. The laboratory tube holder of claim 1 in which said insulating member is a box with a removable lid.

3. The laboratory tube holder of claim 1 in which said openings in said top surface of said tube holding element are arranged in rows and columns.

4. The laboratory tube holder of claim 3 further including a means of identifying said rows and columns of said openings.

5. The laboratory tube holder of claim 1 in which said holes have a shape substantially similar to the laboratory tubes so that the walls of said openings are close to said laboratory tubes.

6. The laboratory tube holder of claim 1 in which there are about 12 to about 144 of said openings in said top surface of said tube holding element.

7. The laboratory tube holder of claim 1 in which there are 96 of said openings in said top surface of said tube holding element arranged in an array of 8 columns by 12 rows.

8. The laboratory tube holder of claim 1 in which said openings in said top surface of said tube holding element are slightly larger than the diameter of the laboratory tubes.

9. The laboratory tube holder of claim 1 in which said thermally conductive tube holding element is made of aluminum.

10. The laboratory tube holder of claim 1 in which said insulating member is made of foamed plastic.

11. The laboratory tube holder of claim 1 in which said cooling element is reusable.

12. The laboratory tube holder of claim 1 in which said tube holding element and said insulating member are the same component.

13. The laboratory tube holder of claim 1 in which there is at least 1 to about 12 said cooling elements.

14. The laboratory tube holder of claim 1 in which said cooling element is electric.

15. The laboratory tube holder of claim 1 in which said cooling element and said lower opening chamber are cylindrical shaped.

16. The laboratory tube holder of claim 1 in which said cooling element and said lower opening chamber are rectangular in shape.

* * * * *